United States Patent [19]

Strickland

[11] 4,295,529

[45] Oct. 20, 1981

[54] BLOW-OUT PREVENTOR

[76] Inventor: William N. Strickland, 210 Tudor St., Houma, La. 70360

[21] Appl. No.: 92,573

[22] Filed: Nov. 8, 1979

[51] Int. Cl.[3] ..... E21B 21/10; E21B 34/08

[52] U.S. Cl. ..... 166/325; 175/321

[58] Field of Search ..... 166/325, 319, 316, 173; 175/321, 235, 320; 251/1 R

[56] References Cited

U.S. PATENT DOCUMENTS 2,802,536 8/1957 Baker ..... 166/173

3,724,541 4/1973 Curry ..... 166/325

*Primary Examiner*—Stephen J. Novosad

*Attorney, Agent, or Firm*—Charles C. Garvey, Jr.

[57] ABSTRACT

A blow out preventor assembly for attachment to the drill stem and being placed within the drill casing during well operations provides a bottom seal assembly having an attachment for slideably attaching the bottom seal assembly peripherally to a section of drill stem with the bottom seal assembly having at least one flow opening allowing oil, gas and drilling fluids to pass there-around. The upper portion of the bottom seal assembly forms a valve which cooperates with a provided port-ring mounted above the bottom seal assembly and having an outer diameter substantially equal to the diameter of the casing. The port-ring forms a flow closure between the drill stem and casing, and has at least one flow opening therethrough and a valve seat at the valve opening adapted to receive the valve portion of the bottom seal assembly. Upper and lower seat rings provide gravitational supports to the port-ring and bottom seal assemblies respectively. A sudden pressure surge will act upwardly on the underside of the bottom seal assembly forcing it upwardly and into direct contact with the top port-ring with the valve portion of the bottom seal assembly contacting the valve seat provided on the port-ring to form a closure. The combined assemblies forced together during the surge move upwardly on the drill pipe as a result of the down hole pressure until the port-ring assembly makes a contact with and seats itself at the bevelled surface portion of a conventional drill stem assembly. Upward movement of the combined assemblies will thus cease and the down hole pressure is contained.

9 Claims, 4 Drawing Figures

BLOW-OUT PREVENTOR

BRIEF DESCRIPTION OF THE DRAWINGS

For a further understanding of the nature and objects of the present invention, reference should be had to the following detailed description, taken in conjunction with the accompanying drawings, in which like parts are given like reference numerals and wherein.

DETAILED DESCRIPTION OF THE PREFERRED EMBODIMENT

Figure 1:
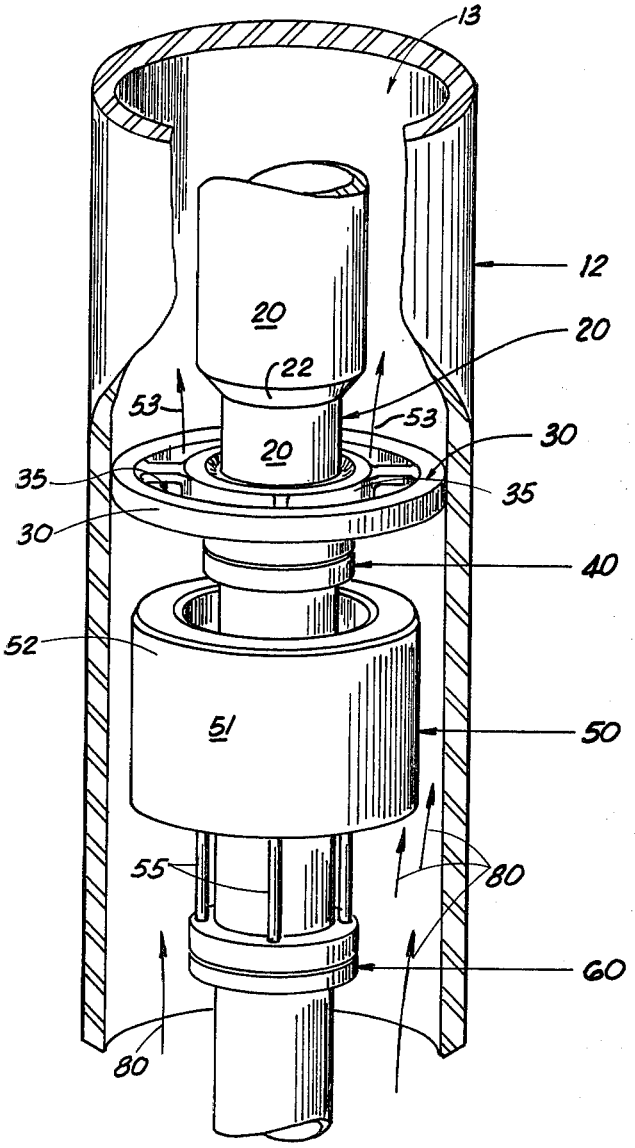
FIG. 1 is a perspective view of the preferred embodiment of the apparatus of the present invention attached during operation to a drill stem within a drill casing, with the casing being shown in a partially broken perspective.
Figure 2:
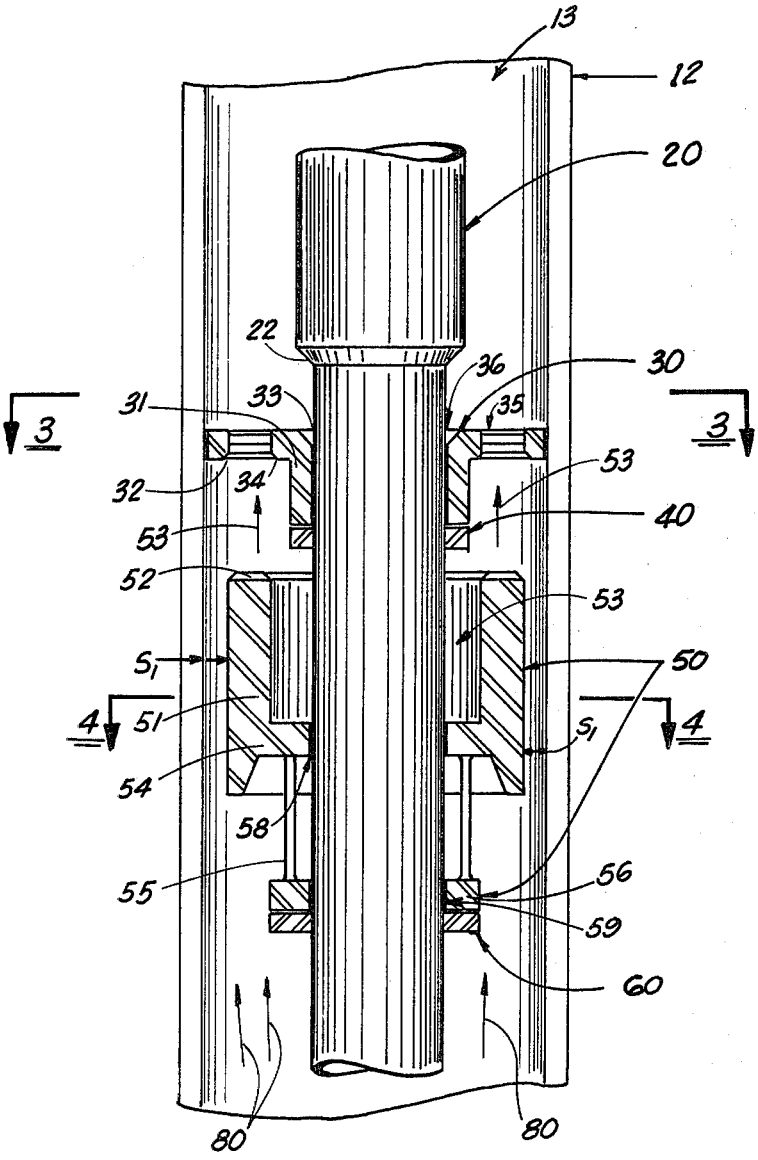
FIG. 2 is a sectional view of the preferred embodiment of the apparatus of the present invention attached to a drill stem within a section of drill casing.

FIGS. 1–4 best illustrate the preferred embodiment of the apparatus of the present invention designated generally by the numeral 10. Blow out preventor 10 is shown in FIGS. 1 and 2 attached to a typical drill stem 20 and mounted within a section of well casing 12.

Blow out preventor 10 comprises generally top port-ring seal assembly 30, upper seat ring 40, bottom seal assembly 50, and lower seat ring 60.

As will be described more fully hereinafter, during operation, blow out pressure indicated by the arrows 80 in FIG. 2 forces bottom seal assembly 50 upwardly (see arrows 53) where upper valve contact surface 52 forms a sealed closure with valve seat 32 of port-ring 30. The entire assembly of bottom seal assembly 50 and port-ring 30 then move upwardly until bevel recess 33 contacts the bevelled surface 22 of stem 20.

Bottom seal assembly 50 comprises an annular wall 51 having upper valve contact surface 52 which corresponds in shape to valve seat 32 of port-ring 30. A recess 53 which is substantially annular is provided between wall 51 and drill stem 20. Note also that a spacing S-1 is provided between annular wall 51 and casing 12.

A solid annular inwardly depending shoulder 54 attaches bottom seal 50 to drill stem 20 in a slidable fashion providing a rib opening 58 which is circular and corresponds to the cross sectional shape of stem 20. A plurality of struts 55 connect annular wall 51 and shoulder 54 to bottom stop ring 56. Stop ring 56 provides an annular opening 59 which likewise is circular corresponding to the circular cross section of drill stem 20.

Figure 3:
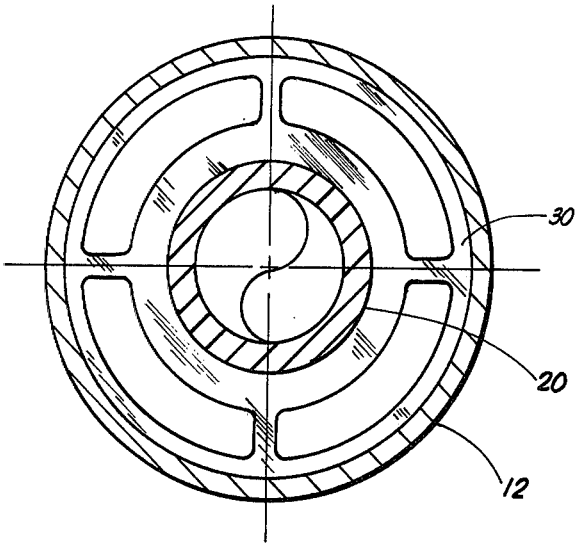
FIG. 3 is a sectional view taken along lines 3—3 of FIG. 2.
Figure 4:
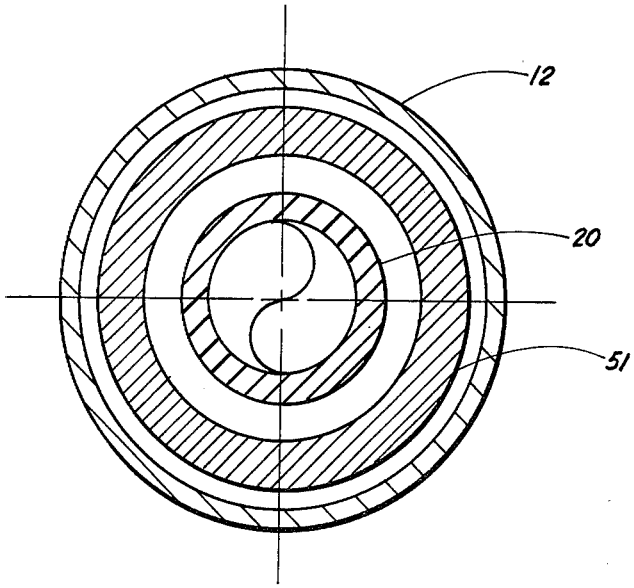
FIG. 4 is a sectional view taken along lines 4—4 of FIG. 2.

Top port-ring assembly 30 is generally annular in configuration, and has a diameter substantially equal to the diameter of the well casing 12 inner bore 13. Port-ring seal 30 provides a lowermost valve seat 32 which is bevelled to correspond with the valve contact surface 52 of bottom seal 50. An upper bevel recess 33 is provided which cooperates with the bevelled surface 32 of stem 20 to form a stop for the entire aasembly when pushed upwardly by a sudden surge, as occurs with a blow out. Port-ring seal assembly comprises generally an inner sleeve 31 which is annular and has a sleeve opening 36 corresponding to the circular configuration of drill stem 20, at least one flow opening 35 allows fluid to flow past port-ring seal 30 through openings 35. In FIGS. 1 and 2, four flow openings are provided. Ribs 37 connect port-ring member 30 and sleeve 31 (FIG. 3).

Arrows 53 indicate the flow of oil, gas, and like fluids upwardly in casing 12. (See arrow 53 in FIG. 2 below the underside 34 of port-ring 30). First and second seat ring 40, 60 are provided, each corresponding to top port-ring 30 and bottom seal assembly 50. Each seat ring 40, 60 is an annular disc provided with a central opening which allows each ring 40, 60 to be slidably attached to drill stem 20.

In operation, each seat ring 40, 60 forms a frictional fit with drill stem 20 and holds port-ring 30 and bottom seal assembly respectively in fixed positions.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A blow out preventor assembly for attachment to the drill stem placed within the drill casing during well drilling operations comprising:

a. a bottom seal assembly having attachment means for slideably attaching said bottom seal assembly to a section of drill stem, which has been placed during drilling operations within a section of drill casing, said bottom seal assembly flow opening area allowing fluids to flow thereby and providing an upper valve closure surface;

b. a first lower seat ring having an inner opening corresponding to the sectional configuration of the drill stem and providing an attachment opening for affixing said seat ring to the drill stem, said lower seat ring disallowing downward movement to said bottom seal assembly with respect to the drill stem;

c. port-ring means slideably attachable to the drill stem and having and outer diameter substantially equal to the inside diameter of the drill casing, for forming a flow closure between said drill stem and the drill casing with said port-ring having at least one flow opening allowing fluid to pass thereby and a valve seat at said opening; and d. a second uppermost seat ring having an inner opening corresponding to the sectional configuration of the drill stem and providing an attachment opening for affixing said seat ring to said drill stem, said port-ring means resting upon said second uppermost seat ring, said second ring preventing downward movement of said port-ring means with respect to the drill stem.

2. The apparatus of claim 1 wherein said port-ring means comprises:

a. a cylindrical port-ring member having an outer diameter substantially equal to the diameter of the drill casing into which it is placed;

b. an inner cylindrical sleeve attached to said port-ring member, said sleeve having an inner sleeve opening corresponding to the cylindrical configuration of the drill pipe to which it is attached;

c. at least one flow opening formed between said sleeve and said port-ring member allowing fluids to pass therethrough; and d. a valve seat about said opening.

3. The apparatus of claim 1 wherein said bottom seal is a cylindrical ring having an inner diameter substantially equal to the drill pipe to which it is attached, and an outer diameter less than the inner diameter of the drill casing.

4. The apparatus of claim 1 wherein said top seal is a cylindrical ring having an inner diameter substantially equal to the drill pipe to which it is attached, and an outer diameter less than the inner diameter of the drill casing.

5. The apparatus of claim 1 wherein said bottom seal assembly comprises an annular wall having an upper valve contact surface, said contact surface corresponding in shape to said valve seat of said port-ring means, said annular wall having an outer diameter smaller than the inside diameter of the drill casing; and a lower stop ring connected to said annular wall, said stop ring providing an annular opening corresponding to the circular cross section of the drill stem.

6. The apparatus of claim 5 further comprising a plurality of struts connecting said annular wall and said stop ring.

7. A blow out preventor assembly comprising:

a. a drill casing;

b. a drill stem placed within said drill casing;

c. a bottom seal assembly attached to a portion of said drill stem;

d. a first lower seat ring having an inner opening corresponding to the sectional configuration of said drill stem and providing an attachment opening for affixing said seat ring to said drill stem, said lower seat ring disallowing downward movement of said bottom seal assembly with respect to said drill stem;

e. port-ring means slideably attached to said drill stem and having an outer diameter substantially equal to the inside diameter of said casing, for forming a flow closure between said drill stem and said casing with said port-ring having at least one flow opening allowing fluid to pass thereby and a valve seat at said opening; and f. a second uppermost seat ring having an inner opening corresponding to the sectional configuration of said drill stem and providing an attaching opening for affixing said seat ring to said drill stem, said port-ring means resting upon said second uppermost seat ring, said second ring preventing downward movement of said port-ring means with respect to said drill stem.

8. The apparatus of claim 7 wherein said drill stem provides a connection end portion larger in diameter than the diameter of said drill stem, and said uppermost seat ring is frictionally attached to said drill stem but can be forced upwardly responsive to a blow out urging said bottom seal assembly to engage said port-ring means with said bottom seal assembly, said port-ring means, and said uppermost seat ring moving together as an assembly upwardly until said enlarged connection end portion is contacted.

9. The apparatus of claim 8 wherein said end connection portion of said drill stem comprises an enlarged cylindrical portion of said drill stem.

* * * * *